US006543157B2

(12) United States Patent
Pan

(10) Patent No.: US 6,543,157 B2
(45) Date of Patent: Apr. 8, 2003

(54) SPORT SANDAL

(76) Inventor: Kung-Sheng Pan, 7F, No. 19-28, Chung Yung Rd., Nan Tun Area, Taichung (TW)

( * ) Notice: Subject to any disclaimer, the term of this patent is extended or adjusted under 35 U.S.C. 154(b) by 0 days.

(21) Appl. No.: 09/802,892

(22) Filed: Mar. 12, 2001

(65) Prior Publication Data

US 2002/0124433 A1 Sep. 12, 2002

(51) Int. Cl.[7] ..... A43B 3/24; A43B 3/12
(52) U.S. Cl. ..... 36/11.5; 36/101
(58) Field of Search ..... 36/101, 11.5, 100

(56) References Cited

U.S. PATENT DOCUMENTS 2,368,314 A * 1/1945 Marx ..... 36/101
2,495,984 A * 1/1950 Roy ..... 36/101
3,983,642 A * 10/1976 Liao ..... 36/101
4,300,294 A * 11/1981 Riecken ..... 36/101
5,423,134 A * 6/1995 Bagnaia et al. ..... 36/101
5,802,738 A * 9/1998 Ferniani ..... 36/101

* cited by examiner

*Primary Examiner*—Ted Kavanaugh
(74) *Attorney, Agent, or Firm*—Browdy and Neimark, P.L.L.C.

(57) ABSTRACT

A sport sandal comprises a sole having at least one through hole, and a strap having at least one placing tape which is replaceably disposed in said through hole of said sole such that said placing tape is joined with said strap in various forms.

8 Claims, 14 Drawing Sheets

(a)

(b)

SPORT SANDAL

FIELD OF THE INVENTION

The present invention relates generally to a footwear, and more particularly to a sport sandal.

BACKGROUND OF THE INVENTION

The conventional sandal consists of a sole which is fastened in various ways to the foot of a person by straps over the instep or toes, or around the ankle. The size of the conventional sandal is fixed, thereby resulting in various problems in connection with production and inventory. In addition, the sole and the straps of the conventional sandal are made of different materials, which complicate the process of recycling the conventional sandal. Moreover, the construction of the soles and the straps of the conventional sandal is not cost-effective.

SUMMARY OF THE INVENTION

It is the primary objective of the present invention to provide an interchangeable sport sandal to afford the consumer a variety of selections.

It is another objective of the present invention to provide an interchangeable sport sandal which can be easily worn.

It is still another objective of the present invention to provide an interchangeable sport sandal which can be easily recycled.

The sport sandal of the present invention comprises a sole and at least one strap fastened with the sole. The sole and the strap are detachably fastened together to facilitate the variation in form of the sandal as well as the process of recycling the sandal.

DETAILED DESCRIPTION OF THE INVENTION

Figure 1:
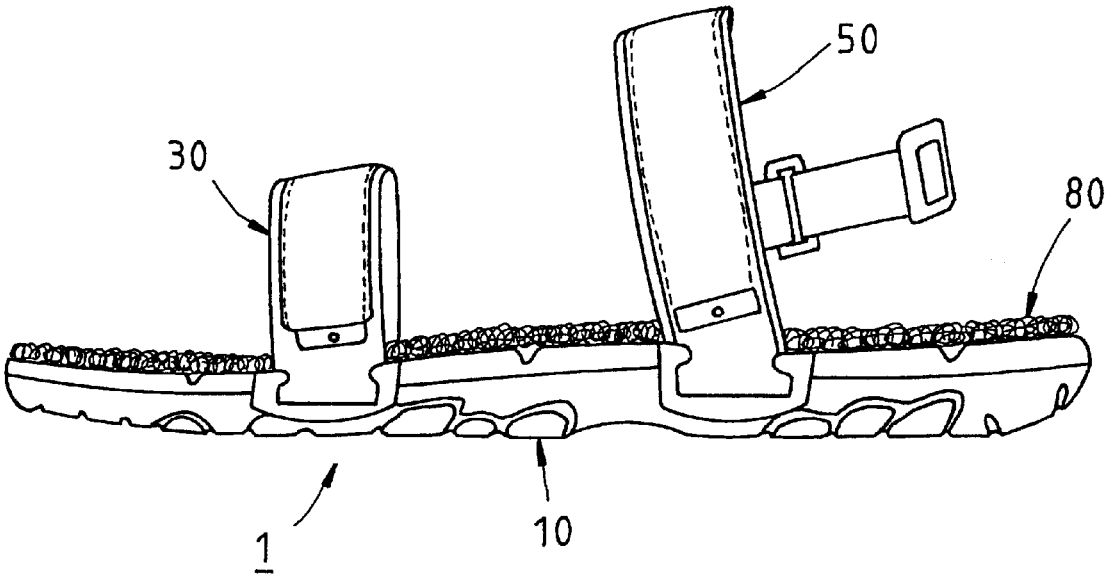
FIG. 1 shows a side schematic view of a first preferred embodiment of the present invention.
Figure 2:
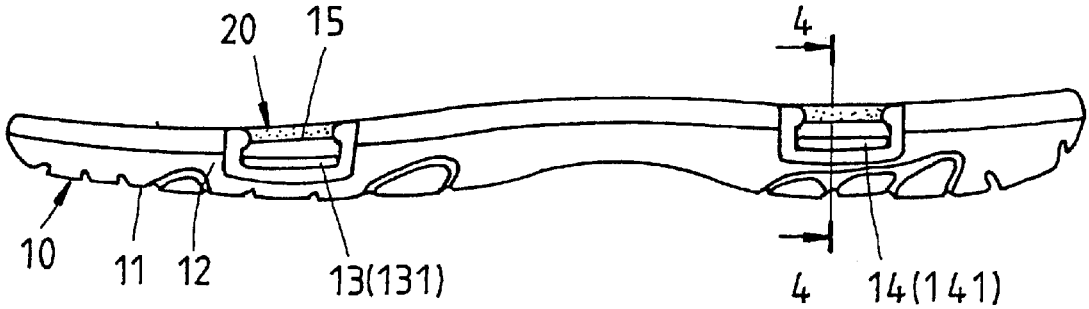
FIG. 2 shows a side view of the sole of the first preferred embodiment of the present invention.
Figure 3:
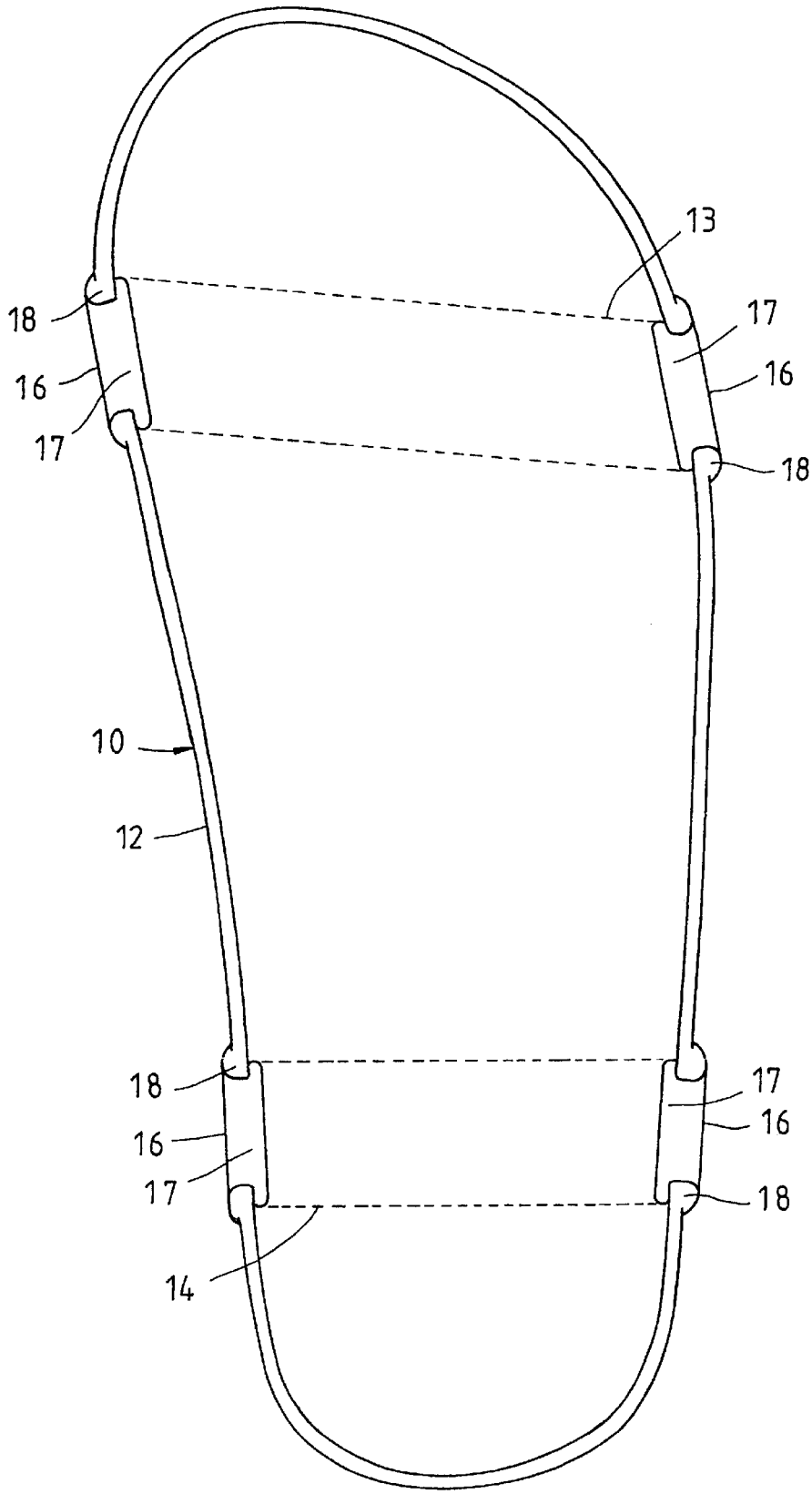
FIG. 3 shows a top view of the sole of the first preferred embodiment of the present invention.
Figure 4:
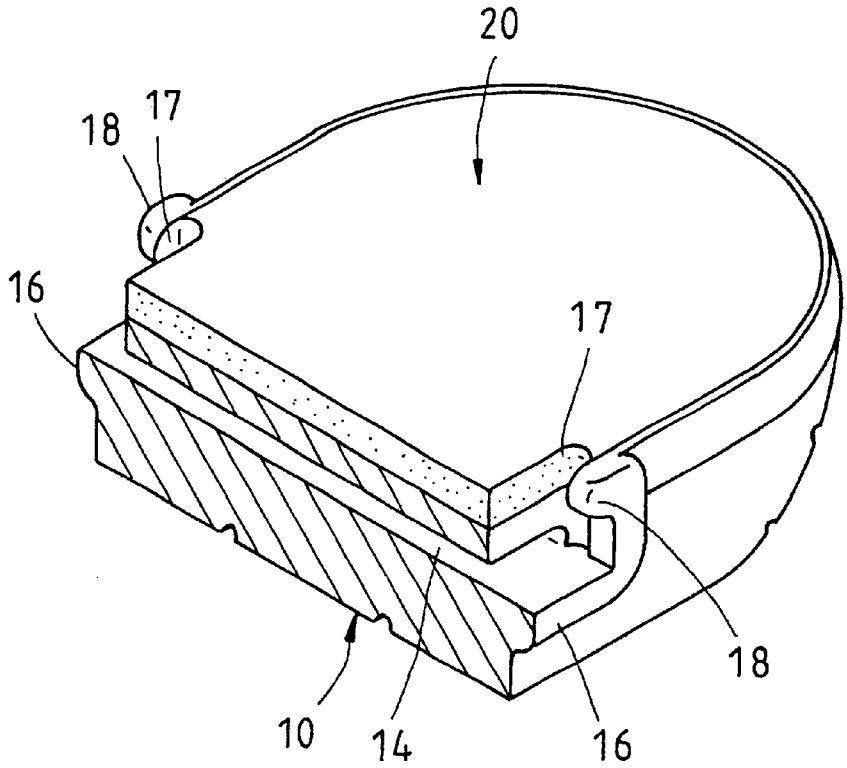
FIG. 4 shows a sectional view taken along a line 4—4 as shown in FIG. 2.
Figure 5:
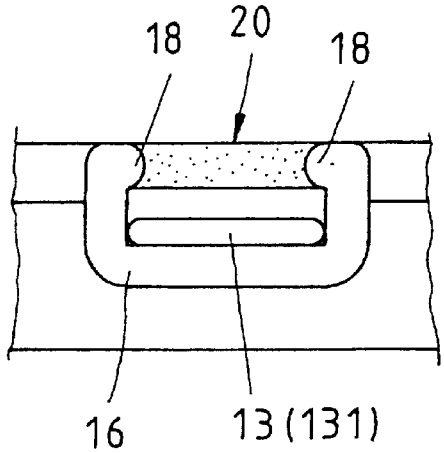
FIG. 5 shows a schematic view of the sole protective wall of the first preferred embodiment of the present invention.

As shown in FIGS. 1–5, a sport sandal 1 embodied in the present invention comprises the component parts, which are described hereinafter.

A sole 10 of a predetermined thickness is formed of a block body 11 having a side surface 12, a first through hole 13, and a second through hole 14. The two through holes 13 and 14 have a long cross section, an opening 131, 141, a top 15. The openings 13 and 14 are provided with a U-shaped protection wall 16. The top 15 is provided with a strap placing recess 17 in communication with the through holes 13 and 14. The recess 17 is provided at the top of the outer side thereof with a stop lug 18.

A midsole 20 is adhered to the top 15 of the sole 10.

A first strap 30 is of a shoe-shaped body 31 and is provided with a placing tape 32 which is in turn provided at the front end with a guide piece 33 which is provided with a hook hole 331. The placing tape 32 can be put through the opening 131 of the first through hole 13 of the sole 10 by means of a tool "A", and two ends thereof with a joining portion 35, 36.

A second strap 50 is of a shoe-shaped body 51 and has a placing tape 52 which is provided at the front end with a guide piece 53 having a hook hole 531. The placing tape 52 is put through the opening 141 of the second through hole 14 of the sole 10 by means of the tool "A". The second strap 50 is provided at two ends with a joining portion 55, 56.

The placing tapes 32 and 52 of first strap 30 and the second strap 50 have a cross section of a long strip shape. The joining portions 35 and 55 are male retaining tapes 71. The joining portions 36 and 56 are female retaining tapes 72 capable of joining with the male retaining tapes 71.

The midsole 20 is provided thereon with a sole touching body 80 made of an elastic fiber filament block and intended to be treaded on by the foot sole, or a shoe pad of other forms.

Figure 6:
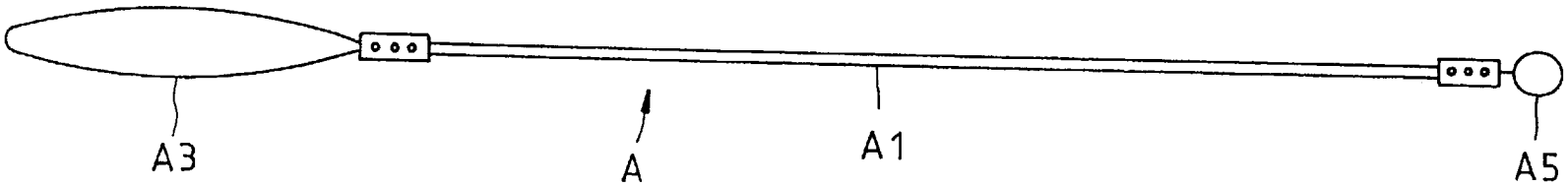
FIG. 6 shows a schematic view of a pull cord of the tool of the present invention.
Figure 7:
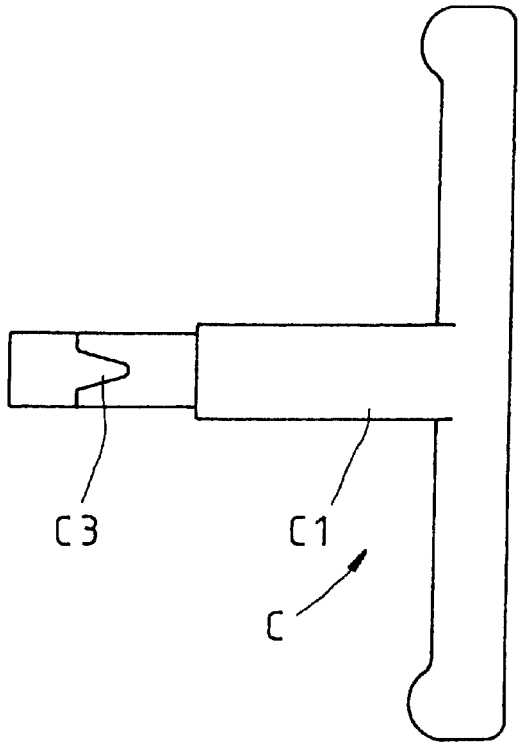
FIG. 7*a* shows a top view of a tool handle of the present invention.
FIG. 7*b* shows a side view of the tool handle of the present invention.
Figure 7:
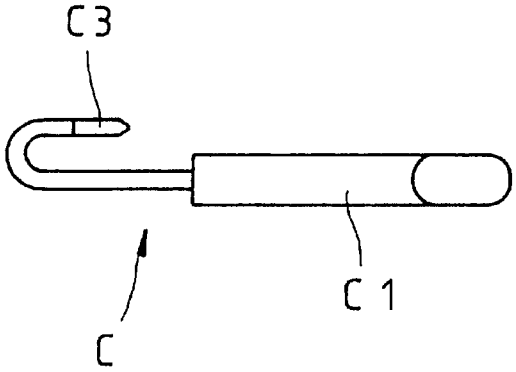

As shown in FIG. 6, the assembly of the present invention is attained by a tool "A" having a cord body A1, which is provided at one end with a fitting ring A3. The cord body A1 is provided at other end with a hook ring A5. As shown in FIG. 7, a pull handle C has a T-shaped grip C1 and a hooked portion C3 for hooking and pulling the hook ring A5 of the tool A.

Figure 8:
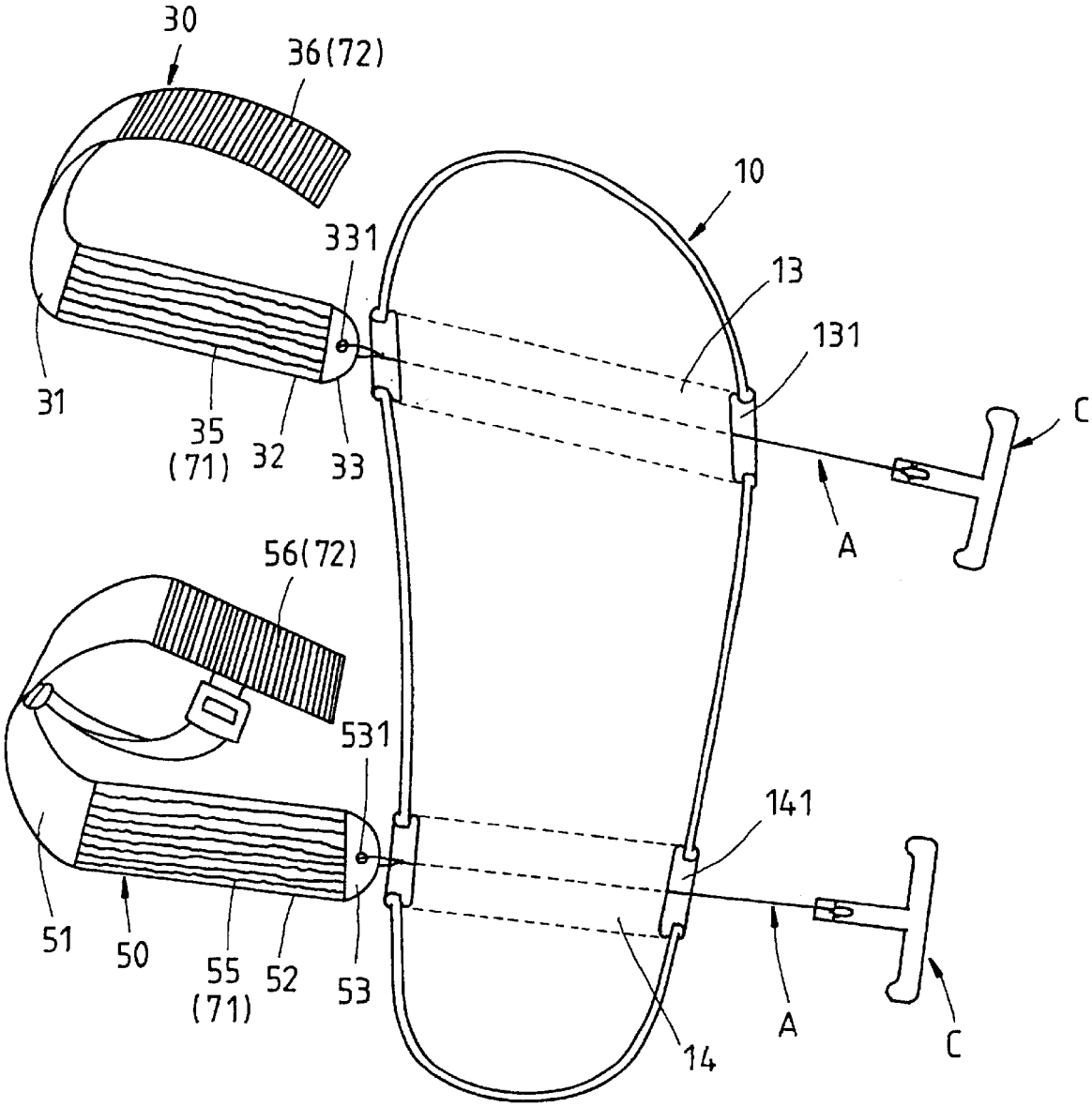
FIG. 8 shows a schematic view of the assembly of the first preferred embodiment of the present invention.

As shown in FIG. 8, the tool A is put through the through holes 13 and 14 such that the fitting rings A3 catch the hook holes 331 and 531 of the straps, and that the hooked portion C3 of the pull grip C hooks to pull the hook ring A5 of the tool A. The placing tapes 32 and 52 of straps 30 and 40 are thus put through the through holes 13 and 14 of the sole 10.

The bodies of the straps 30 and 40 are retained in the inner side of each stop lug 18 of the sole 10 to prevent the escape of the straps from the recess 17. Finally, the male and the female retaining tapes 71 and 72 of the joining portions 35, 36, 55, 56 of the straps 30 and 40 are joined together.

The protection wall 16 serves to prevent the friction of the straps 30 and 50 by the foreign objects. The stop lug 18 serves to prevent the displacing or the loosening of the strap.

The joining portions of the present invention are not confined to the male retaining tape 71 and the female retaining tape 72 and may be replaced with a male retaining button and a female retaining button, or a plurality of insertion holes disposed in the joining portion of the straps and a retaining rod disposed at other joining portion. The retaining rod is inserted into the insertion holes.

Figure 10:
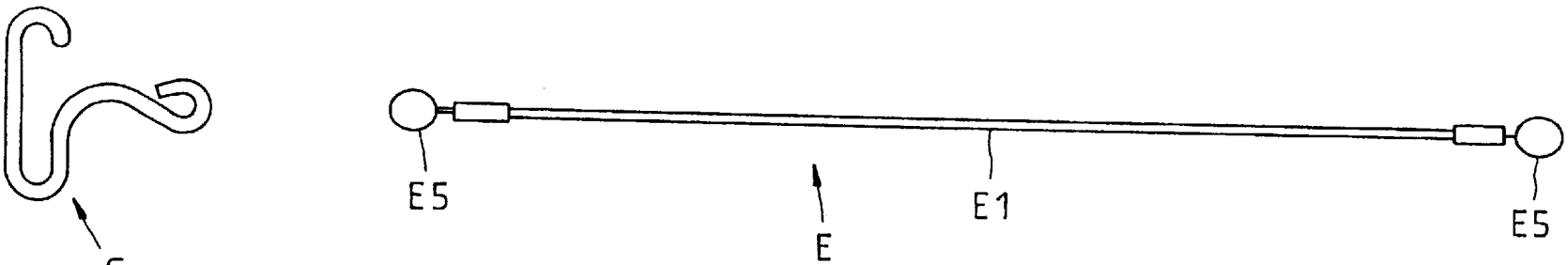
FIG. 10 shows a schematic view of another pull cord of the tool of the present invention.
Figure 9:
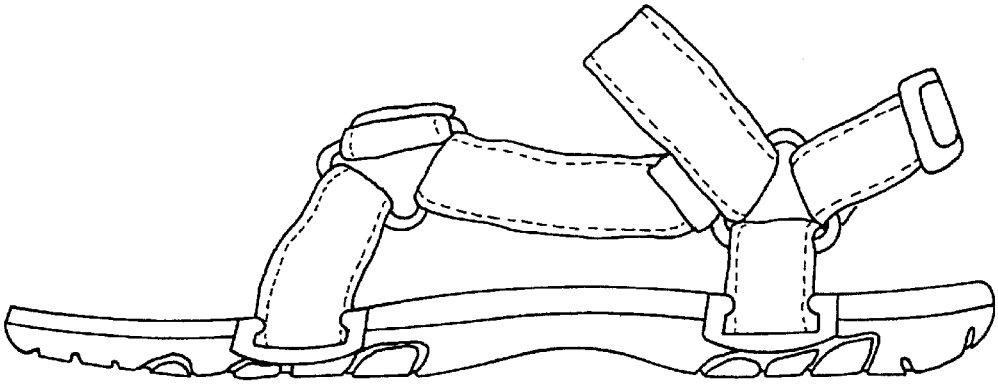
FIG. 9 shows a side view of a second preferred embodiment of the present invention.
Figure 11:
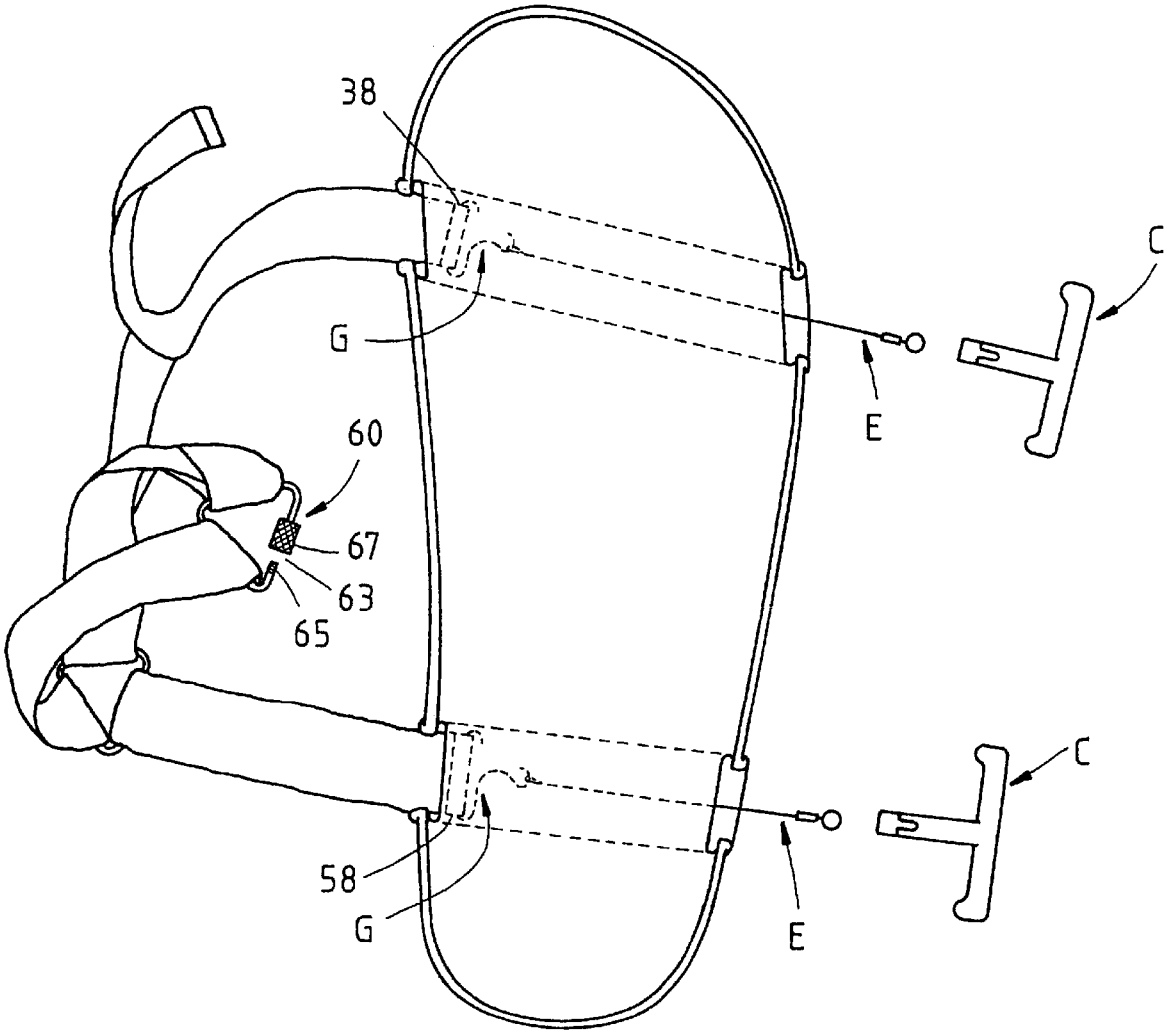
FIG. 11 shows a schematic view of the assembly of the second preferred embodiment of the present invention.

As shown in FIGS. 9–11, the strap of another preferred embodiment of the present invention is provided with a tape retainer 60 of a triangular frame strip, and two placing tapes which are put through the two through holes. The placing tapes are provided at the front end with a horizontal tape hole 38, 58. The tape retainer 60 is provided with a cut 63 and a threaded rod 65 which is engaged with a nut 67.

As shown in FIG. 10, a pull cord E has a cord body E1 which is provided at both ends with a hook ring E5, and a tape hook G capable of being hooked and pulled by the hook ring E5 of the pull cord E. In combination, as shown in FIG. 11, the tape holes 38 and 58 are caught by the tape hook G. Thereafter, the strap is pulled by the pull cord E and the pull handle C such that the hole 58 is joined via the cut 63 of the tape retainer 60.

Figure 12:
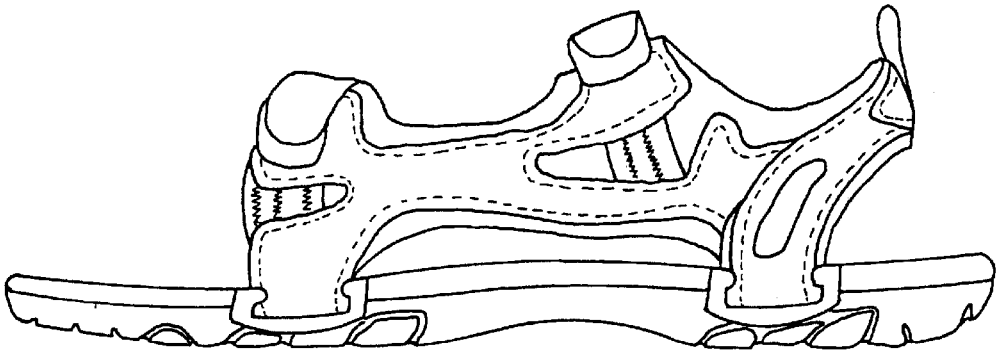
FIG. 12 shows a side view of a third preferred embodiment of the present invention.

As shown in FIG. 12, this preferred embodiment is provided with only one strap which is provided with two placing tapes for putting through the two through holes.

Figure 13:
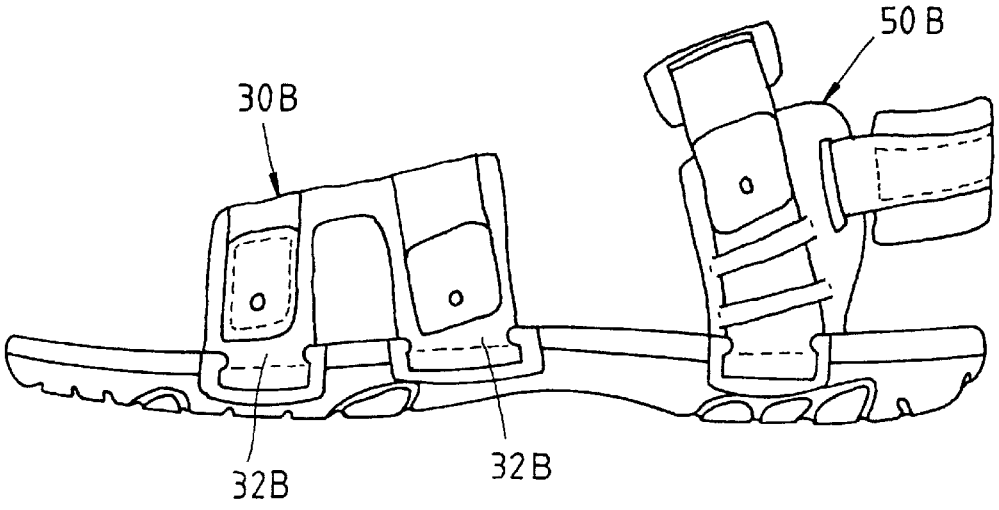
FIG. 13 shows a side schematic view of a fourth preferred embodiment of the present invention.
Figure 14:
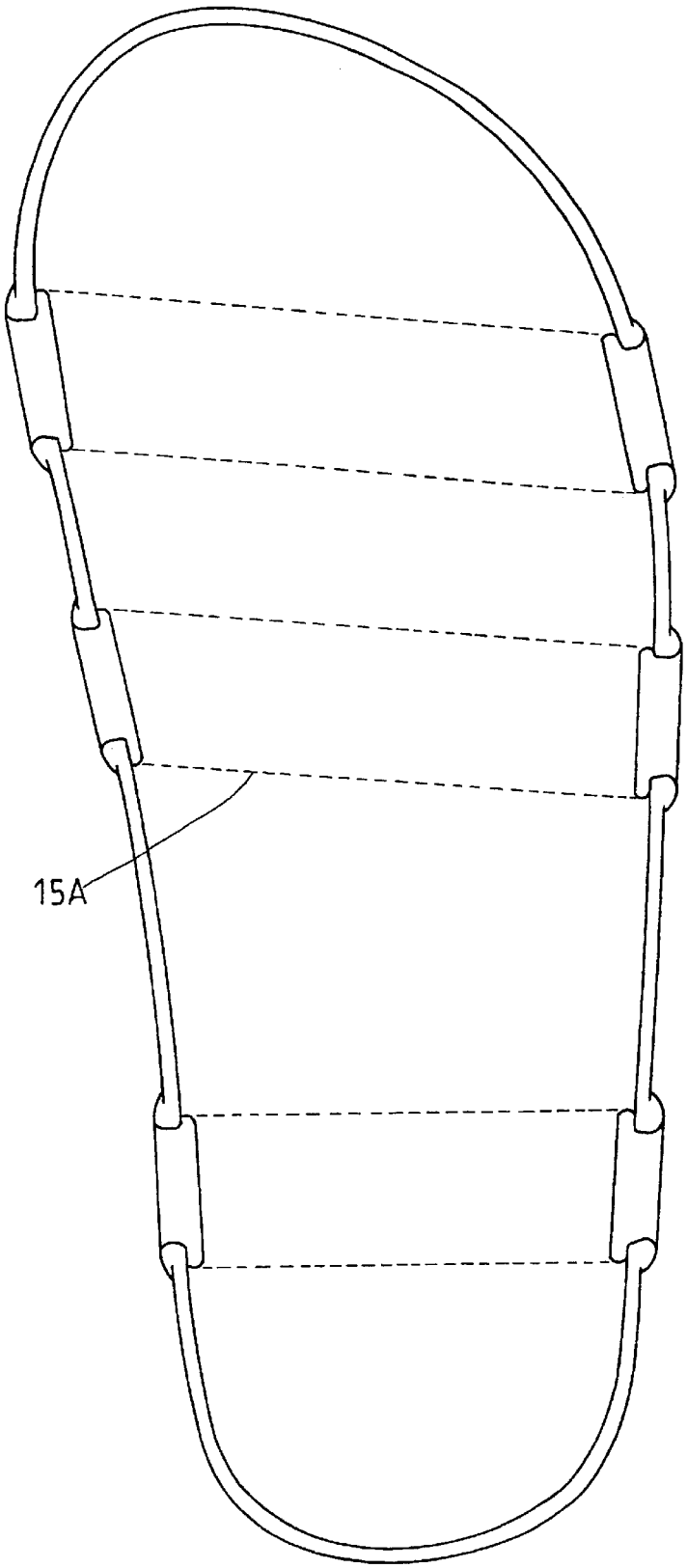
FIG. 14 shows a top view of the sole of the fourth preferred embodiment of the present invention.

The sole of the present invention is not confined to have two through holes or two straps. As shown in FIG. 13, the sole of the present invention is provided with two straps 30B and 50B, with the strap 30B being provided with two placing tapes 32B. As shown in FIG. 14, the sole has a third through hole 15A for receiving one placing tape 32B. The present invention may be provided with a plurality of through holes and straps of various forms.

Figure 15:
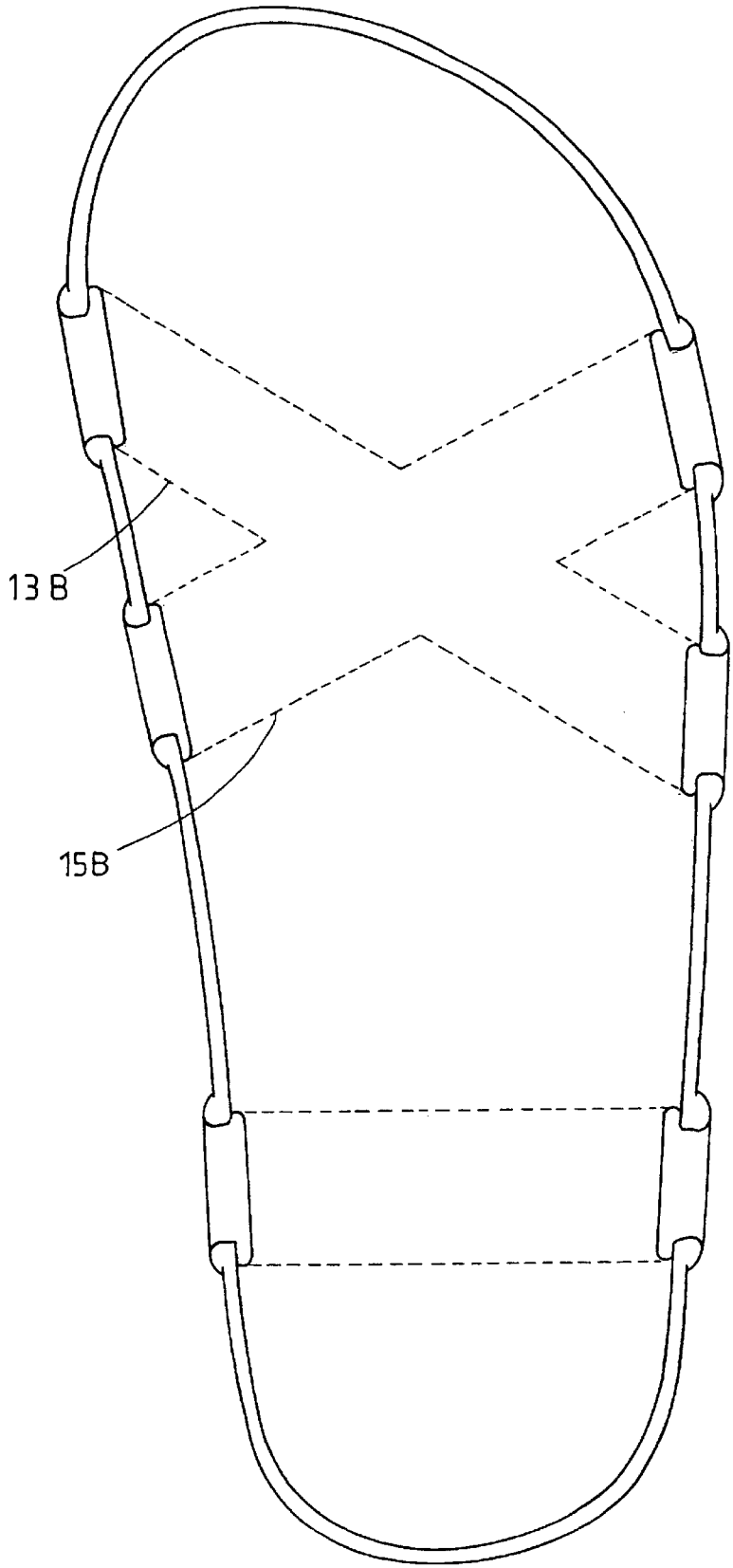
FIG. 15 shows a top view of another sole of the present invention.

In addition, the sole is provided with more than two through holes, which are not necessarily parallel to one another, or intersected. As shown in FIG. 15, the sole of the present invention is provided with the through holes 13B and 15B, which are intersected to facilitate the assembly of straps of various forms.

Figure 16:
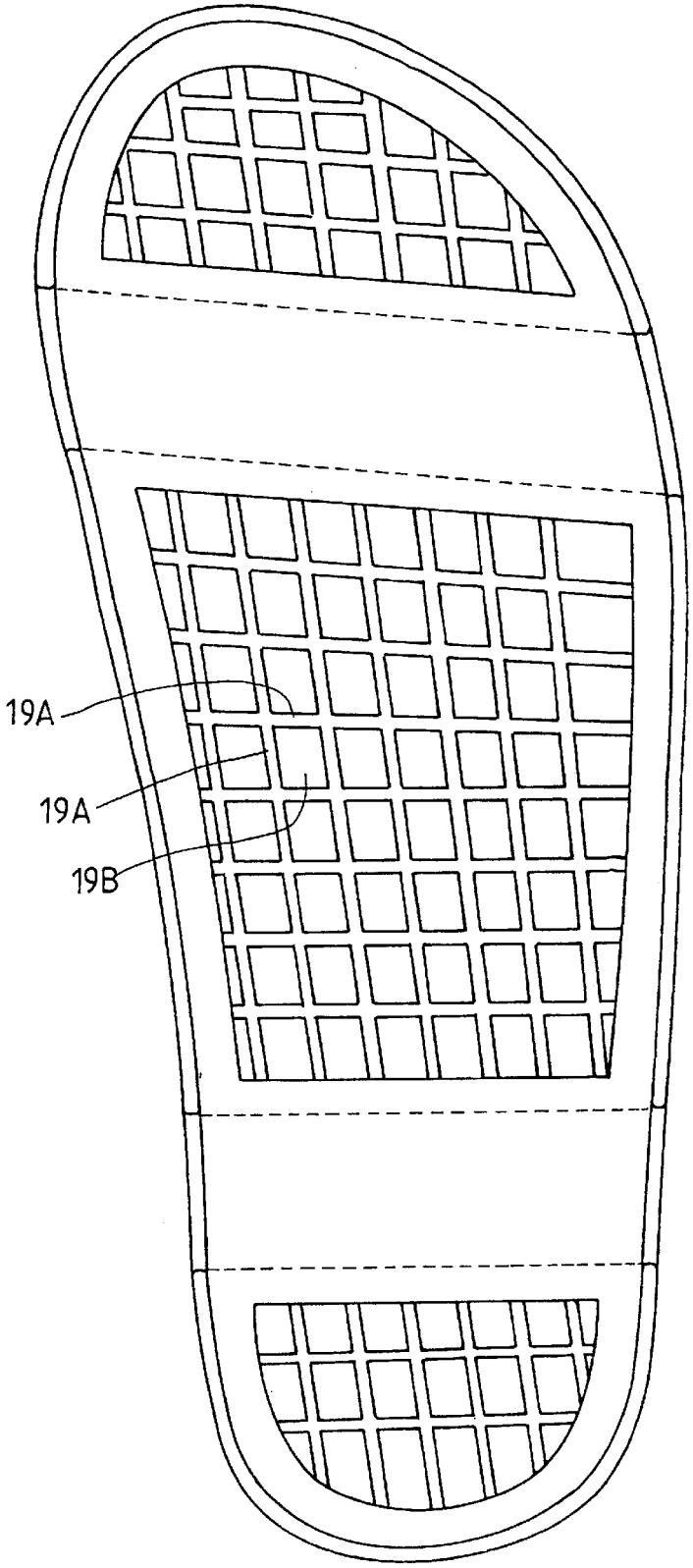
FIG. 16 shows a top view of still another sole of the present invention.

As shown in FIG. 16, the sole of the present invention has areas which are devoid of the through holes and are provided with a plurality of ribs 19A and recesses 19B for reinforcing structural strength of the sole and for reducing the weight of the sole.

Figure 17:
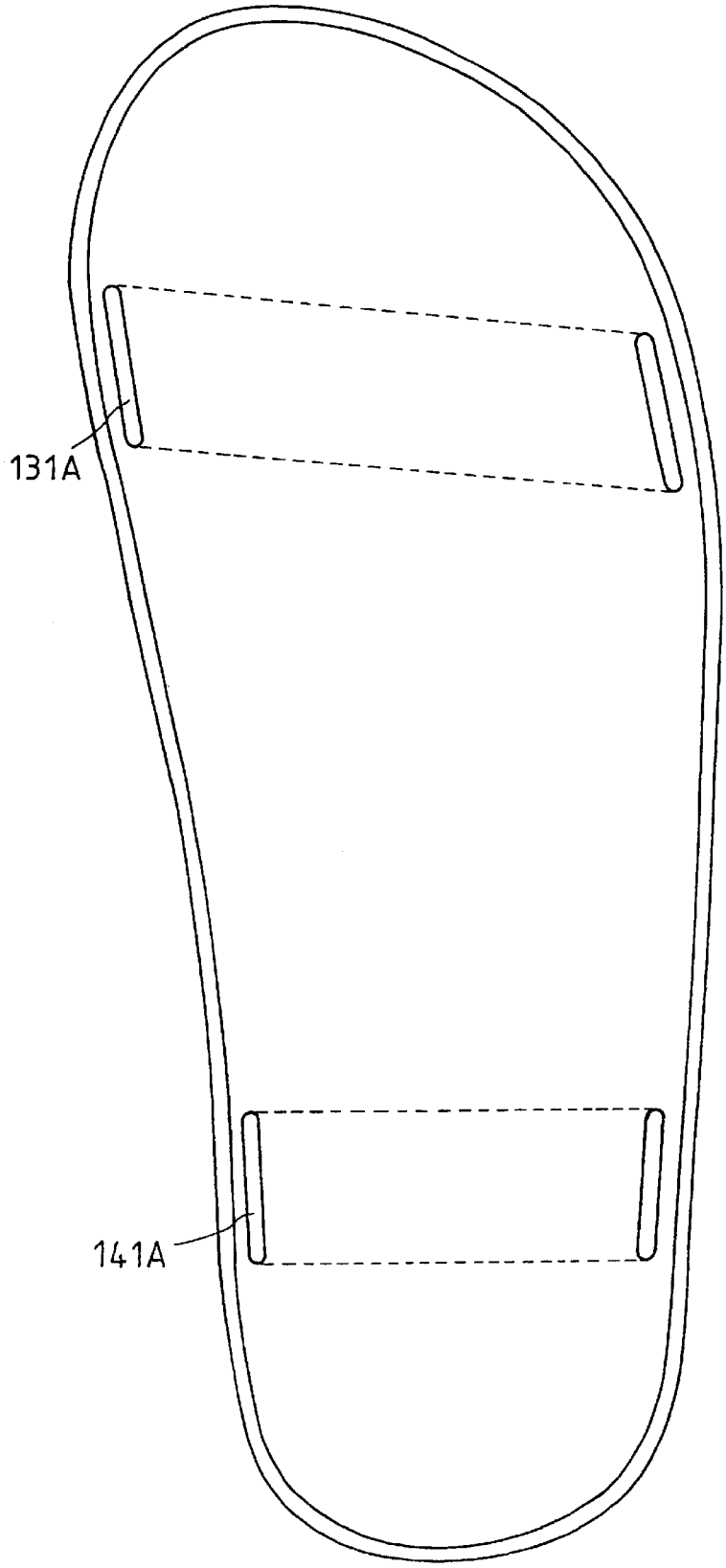
FIG. 17 shows a top view of still another sole of the present invention.

The through holes of the sole are not necessarily located in two sides of the sole. As shown in FIG. 17, the openings 131A and 141A of the through holes of the sole are located at the left top and the right top of the sole.

Figure 18:
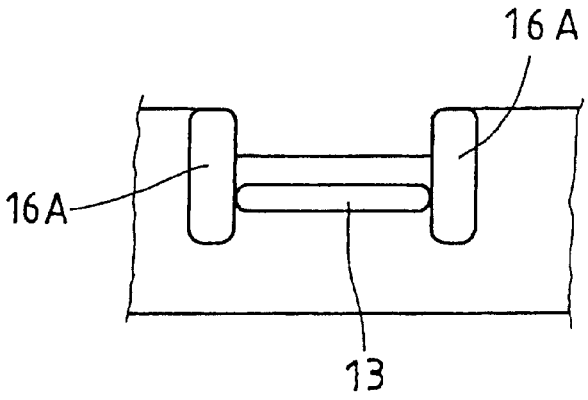
FIG. 18 shows a schematic view of another sole protection wall of the present invention.
Figure 19:
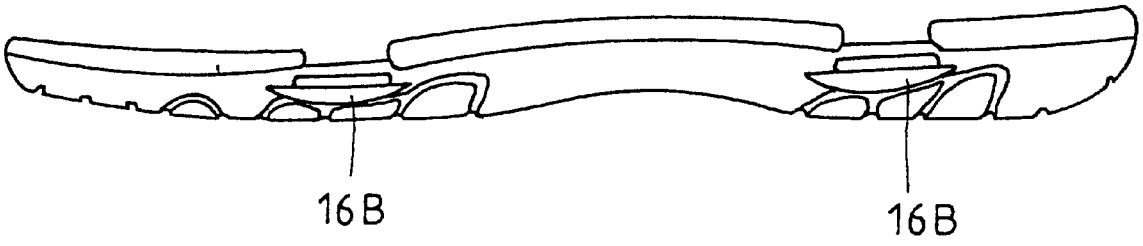
FIG. 19 shows a side view of still another sole of the present invention.

As shown in FIG. 18, the protection walls 16A may be disposed in two sides of the outside of the openings. As shown in FIG. 19, a protection wall 16B is disposed in the lower edge of the opening of the through hole to provide the strap with protection against friction.

Figure 20:
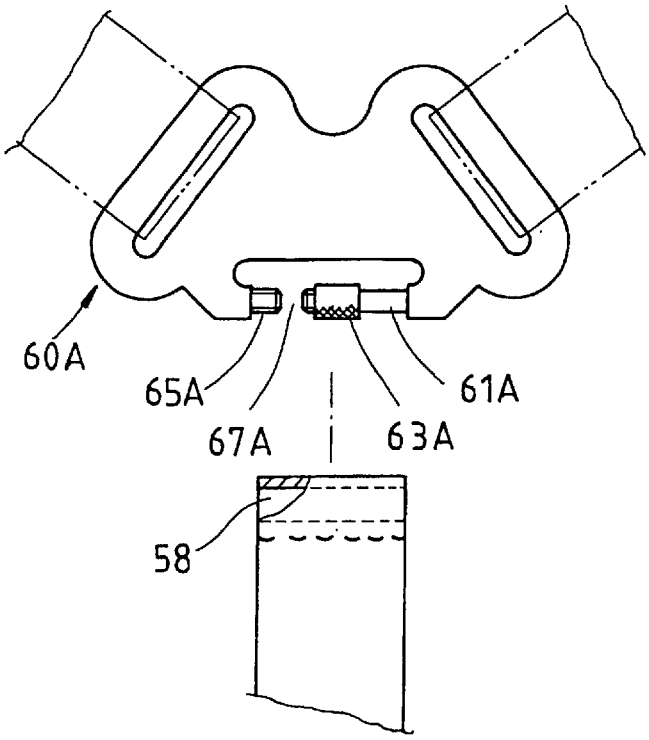
FIG. 20 shows a schematic view of a joining structure of the strap of the present invention.
Figure 21:
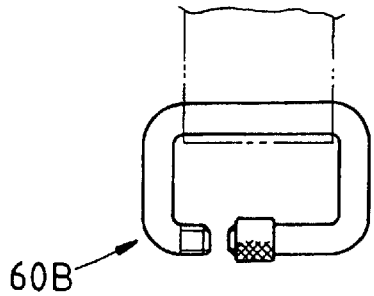
FIG. 21 shows a schematic view of another joining structure of the strap of the present invention.
Figure 21:
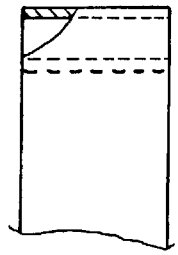

As shown in FIG. 20, the joining of the strap of the present invention may be attained by a triangular tape retainer 60A which is provided in two sides with a tape body. The tape retainer 60A has an insertion rod 61A which is provided with a threaded member 63A, a threaded rod 65A and a notch 67A. The placing tape has a tape hole 58 and is joined with the insertion rod 61A via the notch 67A. As shown in FIG. 21, the tape retainer 60B may be of a tetragonal construction.

Figure 22:
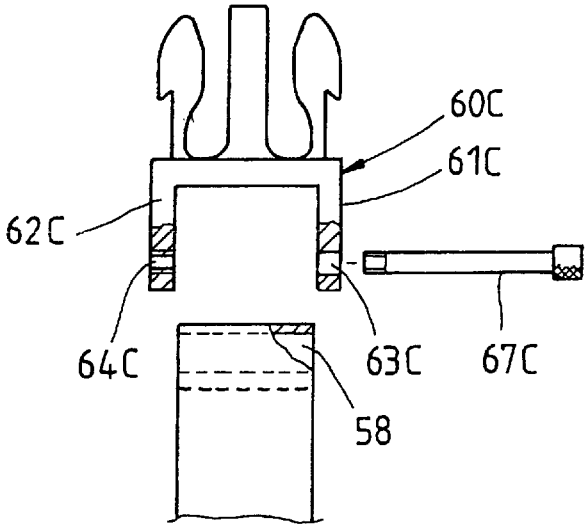
FIG. 22 shows a schematic view of still another joining structure of the strap of the present invention.

As shown in FIG. 22, the placing tape of the strap is detachably joined with an insertion retainer 60C which has two lugs 61C and 62C, which are in turn provided with a through hole 63C and a threaded hole 64C. An insertion rod 67C is received in the through hole 63C. The insertion retainer is not confined to the male insertion retainer or female insertion retainer.

The present invention has advantages. In the first place, the sole and the straps of the present invention are interchangeable. As a result, the versatile sandals are made to provide the consumer with a wide range of selection. The sole and the straps of the present invention are made of different materials and can be easily recycled. The present invention is versatile in design and cost-effective.

What is claimed is:

1. A sport sandal comprising:

a sole provided with at least one through hole and two openings, and at least one strap which is provided with a placing tape to be put through said through hole of said sole such that said placing tape can be attached or detached with said strap;

wherein each of the openings of said through hole is located in a side of said sole and is in communication with a strap placing recess located in a top of the sole; and wherein a pair of lugs project from opposite sides of each of the openings and in front of the strap placing recess so as to maintain the strap in the recess.

2. The sport sandal as defined in claim 1, wherein said through hole of said sole has a cross section of a long hole shape; wherein said placing tape of said strap has a cross section of a long strip shape.

3. The sport sandal as defined in claim 1, wherein said sole is provided with two through holes.

4. The sport sandal as defined in claim 1, wherein each of said openings of said through hole is provided on an outer side thereof with at least one protection wall to provide said strap with protection against friction.

5. The sport sandal as defined in claim 4, wherein said protection wall is of a U-shaped construction and is located at a bottom and two sides of said openings.

6. The sport sandal as defined in claim 1, wherein said sole is provided on a top thereof with a midsole fastened thereto.

7. The sport sandal as defined in claim 1, wherein said placing tape is said strap is provided with a guide piece attached thereto.

8. The sport sandal as defined in claim 1, wherein said placing tape of said strap is provided with retaining tapes capable of retaining each other.

* * * * *